United States Patent [19]

Eisenberg

[11] 4,036,369

[45] July 19, 1977

[54] EXPANDABLE RACK

[75] Inventor: Stephanie Eisenberg, New York, N.Y.

[73] Assignee: Nash Metalware Co. Inc., New York, N.Y.

[21] Appl. No.: 609,588

[22] Filed: Sept. 2, 1975

[51] Int. Cl.[2] ..... A47F 5/08; E04D 13/06

[52] U.S. Cl. ..... 211/88; 211/90; 248/48.2; 108/102

[58] Field of Search ..... 211/88, 90, 153, 126; 248/48.1, 48.2; 61/15; 108/27, 102, 137

[56] References Cited

U.S. PATENT DOCUMENTS

| | | | |
|---|---|---|---|
| 176,979 | 5/1876 | Miller | 248/48.2 |
| 869,195 | 10/1907 | Patchin | 248/48.2 |
| 876,235 | 1/1908 | Quackenboss | 211/153 |
| 883,001 | 3/1908 | Curtis | 211/88 |
| 905,737 | 12/1908 | McCombe | 108/102 X |
| 1,084,414 | 1/1914 | Eger | 211/90 |
| 1,261,513 | 4/1918 | Green | 211/90 X |
| 1,307,211 | 6/1919 | Newlon | 211/88 |
| 1,891,394 | 12/1932 | Otte | 211/153 |
| 3,331,574 | 7/1967 | Davidson | 248/48.2 |

FOREIGN PATENT DOCUMENTS

| | | | |
|---|---|---|---|
| 653,032 | 10/1937 | Germany | 108/137 |

*Primary Examiner*—Roy D. Frazier
*Assistant Examiner*—Terrell P. Lewis
*Attorney, Agent, or Firm*—Samson B. Leavitt; Michael A. Leavitt

[57] ABSTRACT

An expandable rack comprising a plurality of shelf sections, each having beaded longitudinal edges of such size as to allow one section to telescope into the next section and bracket means only slidably supporting said sections and having a shelf receiving portion which substantially matches the exterior shape of said shelf sections thereby allowing said shelf sections freedom of movement only in a longitudinal direction.

4 Claims, 2 Drawing Figures

EXPANDABLE RACK

Figure 1:
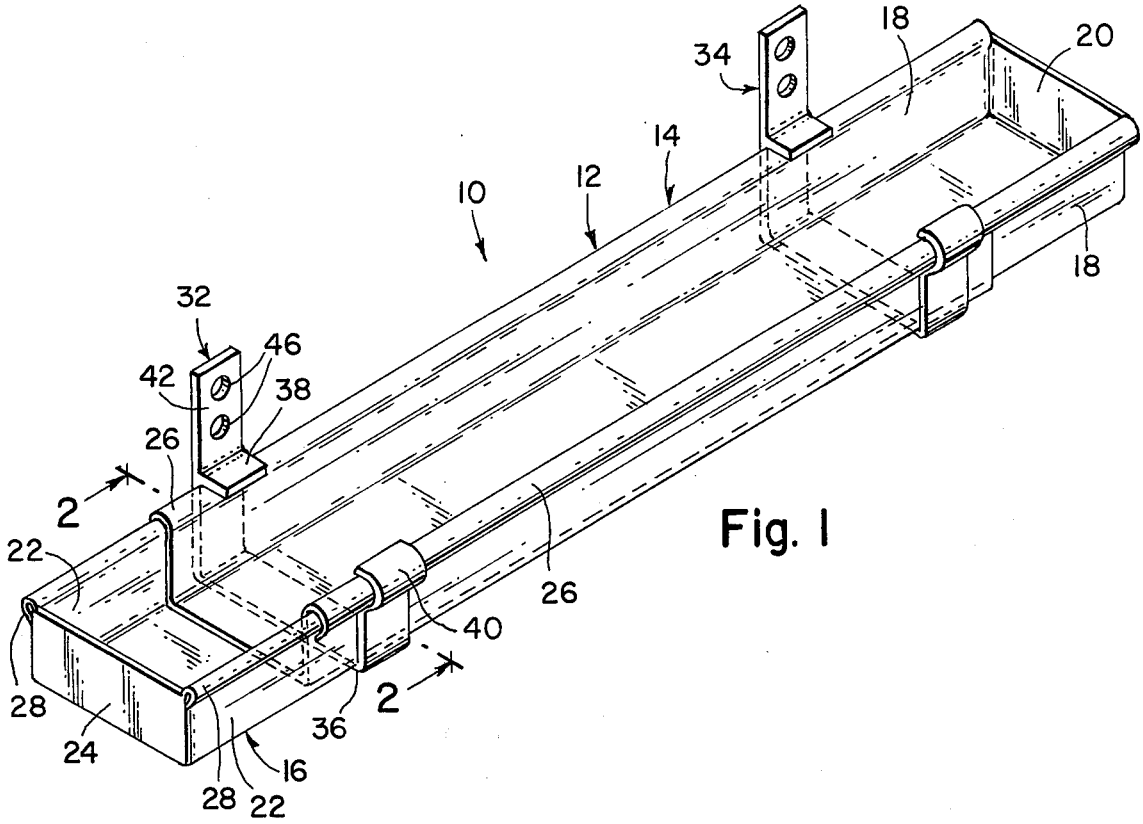

This invention relates to shelves and related articles suitable for supporting various items, and more particularly, to shelves whose length may be varied.

Variable length shelves are known to the public, as, for example, the shelf disclosed in U.S. Pat. No. 905,737 to McCombe. That shelf consists of three sections, each having beaded edges with the beads of the center section being adapted to receive or engage telescopically the beads of the two end sections which are each approximately one-half the length of the center section. The center section is fixedly attached to mounting brackets which are in turn attached to a wall. The length of the resulting shelf can then be adjusted by sliding the end sections onto or off of the center section.

Such a construction, while useful, suffers from several disadvantages. First, this type of construction requires the use of three beaded telescoping sections which are somewhat difficult and costly to manufacture. Second, the shelf with its contents is not readily separated from the supporting brackets. And third, the shelf cannot be moved laterally inward with respect to its supporting brackets without causing some disorganization of items on the shelf.

It is an object of this invention to provide a device which will not be subject to one or more of the above disadvantages. Another object of this invention is the provision of a device of the type described which is relatively simple to manufacture, inexpensive, readily portable, and easily adjustable in both position and length. It is yet another object of this invention to provide an expandable rack in which the material supporting portion may be separated from the mounting means without significantly affecting such supported material.

The attainment of the above objects is made possible by this invention which broadly comprises an expandable rack comprising shelf means consisting of a plurality of shelf sections, said shelf sections being adapted to slide longitudinally into or out of one another whereby the length of said rack may be varied, and bracket means for securing said shelf means to a surface, said bracket means being adapted to only slidably support said shelf means whereby the position of said shelf means may be adjusted with respect to said bracket means by sliding said shelf means within said bracket means.

The invention in a preferred embodiment, includes the provision of two shelf sections with beaded edges such that one section telescopes into the other and two mounting brackets, the shelf receiving portions of which substantially match the exterior shape of the shelf sections and thereby allow only lateral movement of the resulting shelf, but which only slidably support said shelf.

Figure 2:
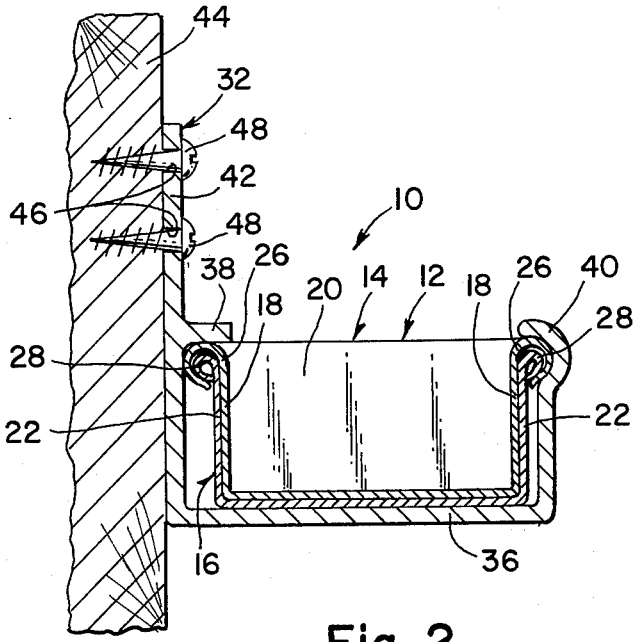

The above brief description, as well as further objects, features and advantages of the present invention, will be more fully apreciated by reference to the following detailed description of presently preferred, but nonetheless illustrative, embodiments in accordance with the present invention, when taken in conjunction with the accompanying drawing, in which:

FIG. 1 is a perspective view of one embodiment with the shelf slightly expanded, and FIG. 2 is a sectional view taken along the line 2—2 in FIG. 1.

Reference is now made to FIG. 1 and 2 of the drawing in which one embodiment of the present invention is illustrated. An expandable rack 10 is provided having shelf means 12 consisting of innermost shelf section 14 and outermost shelf section 16. Shelf section 14 is provided with longitudinal side walls 18 and end wall 20, while shelf section 16 is provided with longitudinal side walls 22 and end wall 24. The upper longitudinal edges of side walls 18 and 22 are rolled to form longitudinal beads 26 and 28, respectively. Beads 26 of innermost shelf section 14 are rolled to a larger radius than beads 28 of outermost shelf section 16, and are not completely closed so that beads 26 can telescopically receive beads 28. Also provided are bracket means comprising brackets 32 and 34. Bracket 32 is provided with shelf receiving portion 36 which includes tab 38 and curved flange 40. The curve of flange 40 is selected to substantially conform to the exterior shape of bead 26, as best seen in FIG. 2, while tab 38 is positioned so that it projects just over the top of bead 26 on the opposite wall from flange 40. Bracket 32 is also provided with portion 42 which is adapted to facilitate securing to a surface 44 by means of holes 46 for receiving screws 48. Bracket 34 is substantially identical to bracket 32 and need not be further described in detail.

To use the expandable rack embodying the instant invention brackets 32 and 34 are secured to a surface 44 by means of screws 48. Brackets 32 and 34 are preferably positioned in the same horizontal plane so that shelf means 12 will be level when inserted therein and are spaced apart by a distance slightly less than the minimum length of shelf means 12 (i.e., when shelf sections 14 and 16 are fully mated). Then, shelf means 12 is inserted into brackets 32 and 34 in one of two ways; either by being slid in from either end or by being "snapped" in from above. Of course, brackets 32 and 34 could be engaged with shelf means 12 before securing said brackets to surface 44, the various choices each offering different advantages.

With brackets 32 and 34 secured, and shelf means 12 inserted, the rack is now ready to receive any suitable "load" or, for example, a number of spice jars. At some time, it may be desired to add to the number of jars and it may become necessary to expand the length of shelf means 12. This is easily accomplished by pulling shelf sections 14 and 16 apart, whereby said sections telescopically slide out of one another and slide in brackets 32 and 34. With the shelf means 12 expanded to the desired length, and the additional jars inserted, shelf means 12 is then longitudinally positioned with respect to brackets 32 and 34 by being slid longitudinally therein. This positioning may be far to the right or left as desired, or centered, so long as both brackets are still in engagement with shelf means 12.

It will be understood that the expandable rack of the instant invention may be provided with more than two shelf sections, all such sections being adapted to telescope into one another, but with only innermost and outermost sections being provided with end walls. Should such a plurality of sections be provided then it is also within the contemplation of this invention to provide more than two brackets, so that additional brackets may be secured as desired to support the increased length of the rack.

Also within the contemplation of the instant invention is the provision of a single bracket comprising the bracket means instead of a plurality of brackets. Such a single bracket would have the same cross-sectional shape as the other brackets, but would be increased in width, preferably to almost the minimum length of the shelf means.

If desired, stop means may be provided in the bead channels to prevent one shelf section from pulling completely out of an adjacent section.

A further variation within the scope of this invention is the provision of bracket means as discussed made of a material which has some degree of "spring," thereby allowing the shelf means to be "snapped" in or out of engagement therewith.

Also, portion 42 of the bracket means above tab 38 may be eliminated, and the mounting holes placed below the tab, or a similar portion may be provided extending in the opposite direction (below the shelf means).

It should be noted that the shelf means of the instant invention can be readily separated from the bracket means without significantly affecting the item supported therein, removed to a desired location, and then easily returned to the bracket means.

This invention has been disclosed with respect to certain preferred embodiments, and it will be understood that various modifications and variations thereof which will be obvious to a worker of ordinary skill in the art are to be included within the spirit and purview of this application and the scope of the appended claims.

What is claimed is:

1. An expandable rack comprising (1) shelf means consisting of a plurality of shelf sections and (2) bracket means for slidably supporting said shelf means at loci intermediate the outer ends thereof and for securing said shelf means to surfaces adjacent only one longitudinal side of said shelf means, said shelf sections being adapted to slide longitudinally into or out of one another whereby the length of said rack and the position of said shelf means with respect to said bracket means can be varied while said bracket means is secured to said surfaces.

2. An expandable rack as defined in claim 1 wherein the upper longitudinal edges of each of said shelf sections are rolled to form longitudinal beads with the size of the beads on each section selected to receive the beads of the preceding section and to fit into the beads of any succeeding section.

3. An expandable rack as defined in claim 2 wherein said bracket means comprises a plurality of brackets and wherein the portion of each bracket which slidably supports said shelf means is formed to substantially match the exterior shape of said shelf sections thereby allowing said shelf means freedom of movement only in a direction parallel to the longitudinal axis of the shelf means.

4. An expandable rack as defined in claim 3 wherein the outermost of said shelf sections is provided with an end wall at one end and the innermost of said shelf sections is provided with an end wall at the opposite end.

* * * * *